United States Patent [19]

Licari

[11] 4,287,993

[45] Sep. 8, 1981

[54] ADJUSTABLE RACK FOR HANGING ARTICLES

[76] Inventor: Vito Licari, 875 Ocean Ave., Elberon, N.J. 07740

[21] Appl. No.: 157,003

[22] Filed: Jun. 6, 1980

[51] Int. Cl.[3] ..... A47F 5/08

[52] U.S. Cl. ..... 211/105; 248/277

[58] Field of Search ..... 211/105, 202; 248/167, 248/277; 16/171, DIG. 13; 403/119, 154, 155, 152, 163

[56] References Cited

U.S. PATENT DOCUMENTS

| | | | |
|---|---|---|---|
| 2,255,461 | 9/1941 | Williams | 248/277 |
| 2,367,253 | 1/1945 | Williams | 211/105 |
| 2,493,936 | 1/1950 | Williams | 211/105 |
| 3,967,803 | 7/1976 | Rienler et al. | 248/346 X |
| 4,202,372 | 5/1980 | Gibbons | 248/277 X |

FOREIGN PATENT DOCUMENTS

| | | | |
|---|---|---|---|
| 9606 | 12/1908 | France | 248/167 |
| 1278498 | 10/1961 | France | 403/163 |

*Primary Examiner*—Roy D. Frazier
*Assistant Examiner*—Robert W. Gibson, Jr.
*Attorney, Agent, or Firm*—Lerner, David, Littenberg & Samuel

[57] ABSTRACT

An adjustable rack is provided which comprises a plurality of hook members for hanging articles attached to a jointed frame comprised of members which are pivotably attached to one another by pin joints. The pin joints comprise elements which are integral with the members. The hook members additionally serve as a component of the pin joints. The aforementioned construction results in an inexpensive adjustable rack which can be advantageously formed from injection molded plastic and which can be assembled in a short amount of time without the use of special tools.

10 Claims, 4 Drawing Figures

ADJUSTABLE RACK FOR HANGING ARTICLES

FIELD OF THE INVENTION

The present invention relates to adjustable racks for hanging articles and more particularly to such adjustable racks having hooks attached to a jointed frame comprised of members which are pivotably attached to one another by pin joints.

Even more particularly, the present invention relates to such adjustable racks wherein the pin joints include elements integral with the members and wherein the hooks serve as a component of the pin joints.

BACKGROUND OF THE INVENTION

In order to store such articles as hats, coats, cookware and the like, various rack designs have been provided for hanging such articles in an orderly fashion. Although there exists many of such rack designs, a rack having hooks attached to a jointed frame is particularly advantageous because the overall dimensions of the rack and, hence, the spacing between the hooks is adjustable. As a result, the rack can be made to accomodate wide and narrow articles as well as to be made to fit wide and narrow storage spaces. Additionally, the rack can be folded into a compact configuration for inexpensive shipment.

Such racks are generally fabricated from a variety of relatively expensive elements such as wooden members, metal screws and the like. Moreover, the production of such racks is relatively complex and time consuming because such elements require the use of tools for assembly.

In accordance with the foregoing, it is a primary object of the present invention to provide an adjustable rack which can be constructed from an inexpensive material.

It is a further object of the present invention to provide an adjustable rack which can be assembled without the use of special tools.

It is still a further object of the present invention to provide an adjustable rack which can be easily assembled in a short amount of time.

SUMMARY OF THE INVENTION

In accordance with the present invention, an adjustable rack for hanging articles is provided comprising at least a first pair of equally sized first and second members adjacent to one another. The second member is provided with at least an aperture. The first member is provided with at least a pin which at one end is integral with the first member. The pin is pivotably engaged within the aperture with the opposite end of the pin protruding through the aperture. Additionally, a hook member is provided having fastening means integral with the hook member. The fastening means fastens the hook member to the opposite end of the pin to thereby fasten the second member to the first member. The hook member, the pin and the aperture define a pin joint to pivotably attach the second member to the first member.

As a preferred embodiment, the hook member can include a bore therein to form the fastening means. In such embodiment, the bore is sized to frictionally engage the opposite end of the pin in an interference fit.

A rack having the construction of the present invention can be entirely formed from inexpensive injection molded plastic because the components of the pin joints are integral with the members that they serve to pivotably attach. Additionally, the assembly of the rack of the present invention is simplified over the prior art. In order to assemble the rack of the present invention, the first member is simply placed against the second member and the pin extended through the aperture. After this, the hook is pressed onto the pin to complete the pin joint. As such, the need for separate metal fittings such as screws, hinges and the like, as well as the tools required to attach the fittings and members together, is eliminated.

BRIEF DESCRIPTION OF THE DRAWINGS

The specification concludes with claims particularly pointing out and distinctly claiming the subject matter which is regarded as the present invention. It is believed, however, that the invention will be better understood from the following description taken in connection with the accompanying drawings in which:

DETAILED DESCRIPTION

While the present invention is by no means limited to the embodiment illustrated herein, the invention will, for simplicity, be described in connection therewith.

Figure 1:
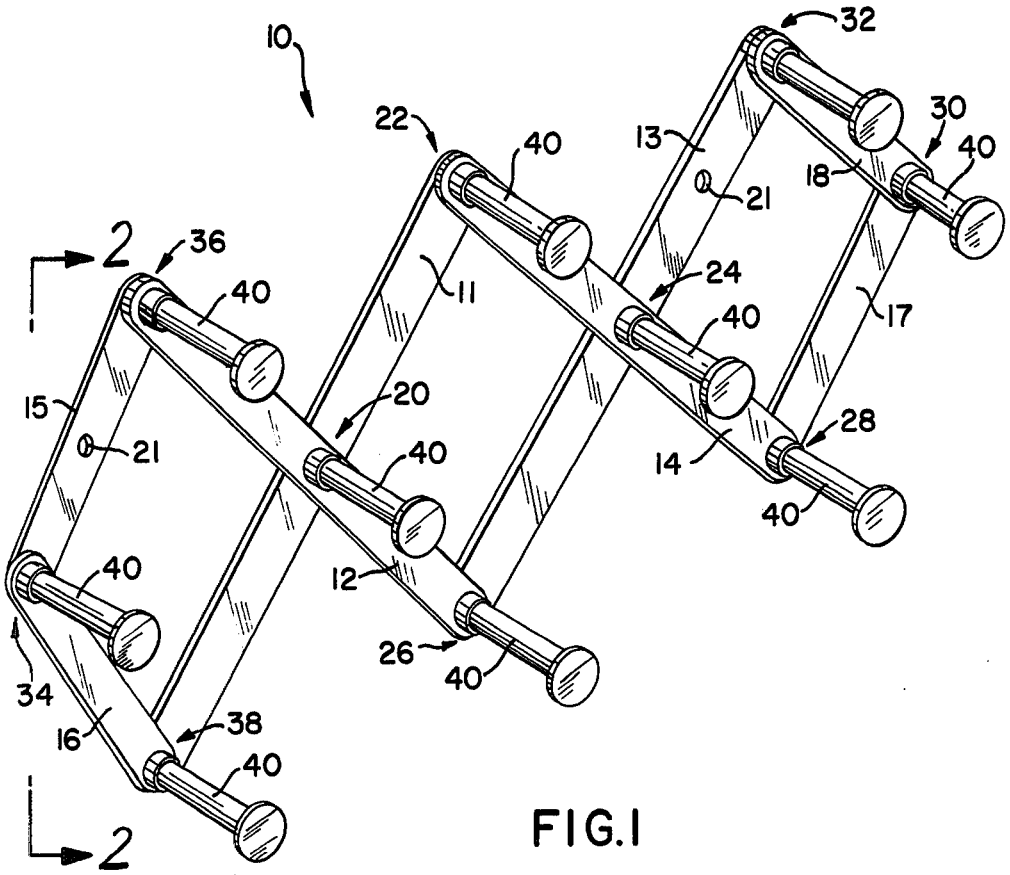
FIG. 1 is a perspective view of a preferred embodiment of the present invention.

Referring now to FIG. 1, there is illustrated a preferred rack 10 of the present invention. The rack 10 can have at least a first pair of equally sized first and second members 11 and 12; a second allochiral pair of first and second members 13 and 14; a third pair of first and second members 15 and 16; and a fourth allochiral pair of first and second members 17 and 18. The members are pivotably attached to one another by pin joints 20, 22, 24, 26, 28, 30, 32, 34, 36, and 38. Each of the aforementioned numbered pin joints are similarly formed.

Figure 2:
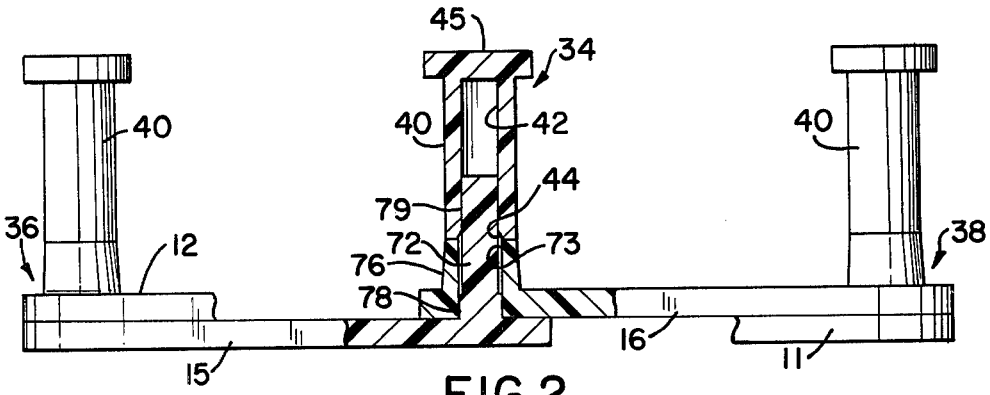
FIG. 2 is an enlarged partial cross-sectional side elevational view taken along section line 2—2 of FIG. 1.

Referring now to FIG. 2, there is illustrated the construction of pin joint 34 which is typical of the pin joints utilized throughout the present invention. The pin joint 34 generally comprises an aperture 73 through the second member 16, a pin 72 pivotably engaged within the aperture 73, and a hook member 40 fastened to the pin 72.

As illustrated in FIG. 1, the adjustable rack 10 as a preferred embodiment can incorporate a lazy tong configuration which is free to distort under loading to thereby provide the necessary adjustable feature of the rack. The first pair of members 11 and 12 and the second pair of members 13 and 14, are positioned to form a central parallelogram defined by pin joints 20, 22, 24, and 26. In the aforementioned central parallelogram, the first members 11 and 13 are parallel to one another and the second members 12 and 14 are parallel to one another. Additionally, the second members 12 and 14 are adjacent to the first members 11 and 13.

Figure 3A:
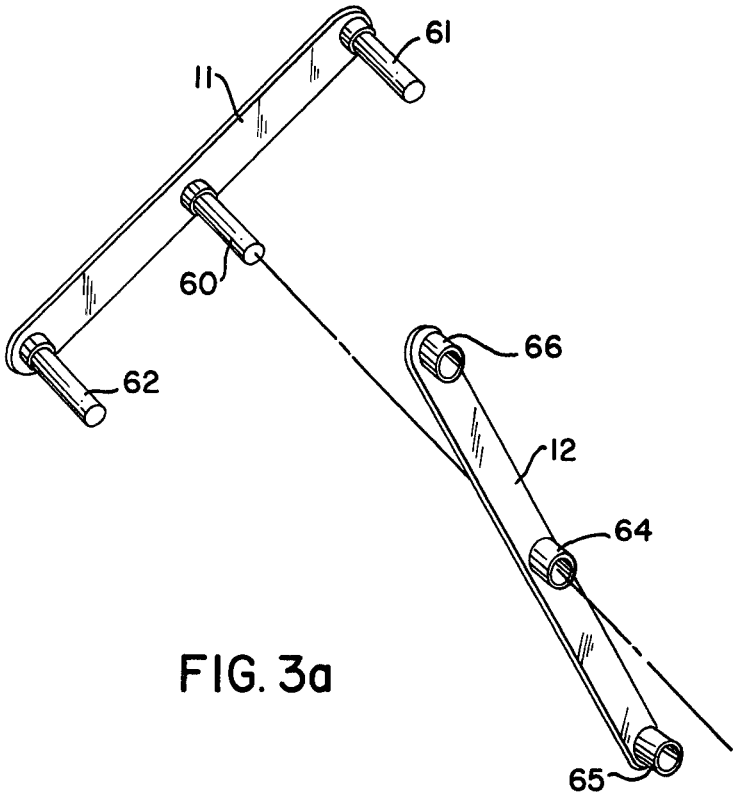
FIG. 3A is an exploded perspective view of the first pair of first and second members of the preferred embodiment illustrated in FIG. 1.

Referring now to FIG. 3A, there is illustrated the first member 11 and the second member 12. Although not illustrated, since the second pair of members is allochiral to the first pair, FIG. 3A is likewise applicable to the first and second members 13 and 14 except that position of pins 61 and 62 illustrated in FIG. 3A is reversed for first member 13 and the position of apertures 65 and 66 illustrated in FIG. 3A is reversed for second member 14. Thus, each of the first members 11 and 13 can be provided with a pin 60 located at its center, a pin 61 located at one end and a pin 62 located at its opposite end. Each of the second members 12 and 14 can be provided with an aperture 64 located through its center, an aperture 65 located at one end and an aperture 66 located at its opposite end. The pins 60, at the centers of first members 11 and 13 extend respectively through the aperture 64 of the second member 12 and the aperture 64 of the second member 14 to form central pin joints 20 and 24. Additionally, as between the first and second pairs, the pins 61 of the first members 11 and 13 extend respectively through aperture 65 of the second member 12 and the aperture 65 of the second member 14 to form pin joints 22 and 26.

Additionally, two allochiral third and fourth pairs of first and second members 15 and 16; and 17 and 18 are provided. The third and fourth pairs are positioned so that the first and third pairs and the second and fourth pairs respectively form two outlying parallelograms. The outlying parallelograms are defined by pin joints 24, 28, 30, and 32; and 20, 34, 36, and 38. In each of the outlying parallelograms, the first members 11 and 15; and 13 and 17 are parallel with one another and the second members 12 and 16; and 14 and 18 are parallel with one another.

Figure 3B:
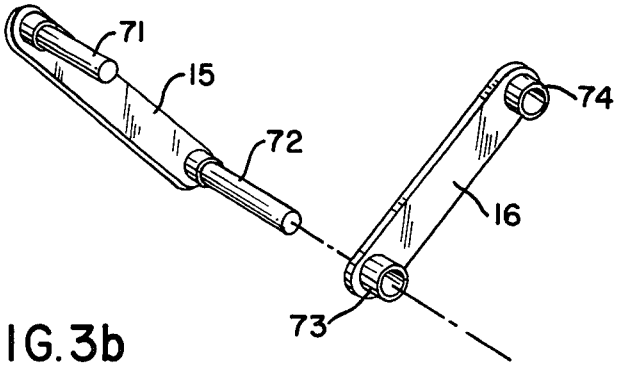
FIG. 3B is an exploded perspective view of the third pair of first and second members of the preferred embodiment illustrated in FIG. 1.

Referring now to FIG. 3B, which illustrates the first and second members 15 and 16, in a manner similar to that of the first and second pairs, FIG. 3B is likewise applicable to the first and second members 17 and 18. Each of the first members 15 and 17 is provided with a pin 71 located at one end and a pin 72 located at its opposite end. Each of the second members 16 and 18 is provided with an aperture 73 located at one end and an aperture 74 located at its opposite end. The pins 71 of the first members 15 and 17 extend respectively through the aperture 66 of the second member 12 and the aperture 66 of the second member 14 to form pin joints 36 and 28. The pins 72 of the first members 15 and 17 respectively extend through the aperture 73 of the second members 16 and the aperture 73 of the second member 18 to form pin joints 34 and 30. The pins 62 of the first members 11 and 13 extend respectively through the aperture 74 of the second member 16 and the aperture 64 of the second member 18 to form pin joints 38 and 32.

In a manner which will be discussed in more detail hereinafter, the hooks 40 are installed on the ends of the pins which protrude through the apertures to complete the pin joints and to thereby fasten the second members to the first members.

The aforementioned pin joints and the repeating parallelogram nature of the rack permits the members of the first and second pairs to be pivoted towards each other; the members of the first and third pairs to pivoted towards each other; and the members of the second and fourth pairs to be pivoted towards each other. This movement decreases the horizontal separation of the hooks and increases the vertical separation of the hooks. In the rack 10, the first members 15 and 17 and the second members 16 and 18 of the third and fourth pairs are sized at one half the length of the first members 11 and 13 and the second members 12 and 14 of the first and second pairs to permit the rack 10 to be completely folded.

It is understood that the hereinbefore described rack can have other configurations without departing from the spirit and scope of the invention. For instance, the rack could incorporate a single first pair of first and second members 11 and 12, or the rack could incorporate additional second pairs of first and second members 13 and 14 to increase the reach of the rack. Alternatively, the third and fourth pairs of members could be deleted.

Referring again to FIG. 1, a set of openings 21 is provided within the second members 13 and 15 to attach rack 10 to a vertical surface by means of screws. Other well known means, such as an adhesive backing could similarly function.

Referring again to FIG. 2, it can be seen that the pin 72 is integral at one end with the first member 15. The pin 72 is pivotably engaged within the aperture 73 of the second member 16 with the opposite end of the pin protruding through the aperture 73. In the illustrated embodiment, aperture 73 can include a coaxial sleeve 76 integral with second member 16. In such case, the pin 72 is sized such that its opposite end also protrudes through the sleeve 76. One end of the pin 72 can be provided with an enlarged shoulder portion 78 adjacent to the first member and a narrow shank portion 79 at one end integral with the shoulder 78. In such an embodiment, the shoulder 78 is sized to pivotably engage within the aperture 73 with the opposite end of the shank portion 79 protruding through the aperture 73. The advantage of the shoulder construction is that it facilitates assembly of the members in that the shank 79 has a smaller diameter than the aperture 73, to aid in locating the pin 72 within the aperture 73.

The hook member 40 is fastened to the opposite end of the pin, or as in a preferred embodiment, to the shank portion 79 of the pin 72 to complete the pin joint. A variety of well known fastening means can be employed to fasten the hook member to the pin 72. As a preferred embodiment, the fastening means can comprise a bore 42 sized to frictionally engage the opposite end of the pin 72 in an interference fit. The hook member 40, when fastened to the pin 72, bears against the second member. Thus the hook member serves, in the present invention, to fasten the second members to the first members. The bore 42 should have a diameter less than that of the preferred shank portion 79 to produce the interference fit. As a preferred embodiment, the shank 79 of the pin 72 can be roughened to increase the degree of frictional force and hence, create a stronger attachment between hook member 40 and pin 72.

The mouth of bore 42, as a preferred embodiment, can have an inverted frustro conical cross-section 44, to aid in locating the pin 72 within the bore 42.

The hook member 40, additionally, can have an enlarged head 45, to prevent articles from slipping off the hook.

The present invention is advantageously fabricated from plastic in a single molding operation. In this regard, a preferred plastic is pigmented polyprophelene.

It is understood that the forms of the invention herein illustrated are to be taken as a preferred embodiment. Various changes and omissions can be made without departing from the spirit and scope of the invention as described in the appended claims.

What is claimed is:

1. A rack for hanging articles comprising: at least a first pair of equally sized first and second members adjacent to one another, said second member having at least an aperture therethrough and said first member having a pin at one end integral with said first member, said pin being pivotably engaged within said aperture with the opposite end of said pin protruding through said aperture; and at least a hook member having a bore therein, said bore being sized to frictionally engage said opposite end of said pin in an interference fit and to thereby fasten said second member to said first member, said hook member, said pin and said aperture defining a pin joint to pivotably attach said first member to said second member.

2. The rack of claim 1 in which said pin comprises an enlarged shoulder portion adjacent to said first member to pivotably engage said aperture and a narrow shank portion, one end of which is integral with said shoulder, the opposite end of which protrudes through said aperture and in which said bore is sized to frictionally engage the said opposite end of said shank portion.

3. The rack of claim 2 in which the surface of said shank portion is roughened to increase the frictional engagement of said pin with said bore.

4. The rack of claim 3 in which the mouth of said bore has a inverted frustro conical longitudinal cross-section to aid in locating said pin in said bore.

5. The rack of claim 4 in which said aperture further comprises a coaxial sleeve integral at one end with said second member.

6. The rack of claim 5 in which said hook member has an enlarged head to prevent articles from slipping off said hook member.

7. The rack of claim 6 in which said aperture is located at the center of said second member and said pin is located at the center of said first member to define a first pair of members having a central pin joint and, in which said rack further comprises at least a spaced allochiral second pair of first and second members having a central pin joint, said first and second pairs having their respective first members and second members forming a central parallelogram with respective first members parallel to one another and respective second members parallel to one another and adjacent to said first members, said first and second pairs having two pin joints pivotably connecting one end of said first pair's first member to one end of said second pair's second member and visa versa.

8. The rack of claim 7 including at least two spaced allochiral third and fourth pairs of members positioned on either side of said central parallelogram, said second pairs positioned so that the second members of said first and third pairs, and the members of said second and fourth pairs respectively form two opposed outlying parallelograms, said first and third pairs being pivotably connected to one another; said second and fourth pairs being pivotably connected to one another; and the respective members of said third pair and said fourth pair being pivotably connected to one another.

9. The rack of claim 8 in which all of the pivotable connections are similarly formed.

10. The rack of claims 1, 2, 3, 4, 5, 6, 8, 9 or 10 in which all of said first and second members and all of said pin joints are formed from injection molded plastic.

* * * * *